US009849318B2

(12) United States Patent
Siewert et al.

(10) Patent No.: US 9,849,318 B2
(45) Date of Patent: Dec. 26, 2017

(54) FIRE SUPPRESSION SYSTEM WITH VARIABLE DUAL USE OF GAS SOURCE

(75) Inventors: Bryan Robert Siewert, Clinton, CT (US); May L. Corn, Manchester, CT (US); Jeffrey M. Cohen, Hebron, CT (US); Michael R. Carey, East Hampton, CT (US); Mike Lindsay, Swainsboro, GA (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 508 days.

(21) Appl. No.: 13/976,476

(22) PCT Filed: Dec. 30, 2010

(86) PCT No.: PCT/US2010/062451

§ 371 (c)(1),
(2), (4) Date: Jun. 27, 2013

(87) PCT Pub. No.: WO2012/091710

PCT Pub. Date: Jul. 5, 2012

(65) Prior Publication Data

US 2013/0264075 A1 Oct. 10, 2013

(51) Int. Cl.
*A62C 35/02* (2006.01)
*A62C 5/00* (2006.01)
(Continued)

(52) U.S. Cl.
CPC ..... *A62C 35/023* (2013.01); *A62C 5/002* (2013.01); *A62C 5/022* (2013.01); *A62C 35/026* (2013.01); *A62C 99/0072* (2013.01)

(58) Field of Classification Search
CPC ..... A62C 5/008; A62C 35/023; A62C 35/026; A62C 35/645; B05B 7/2416
(Continued)

(56) References Cited

U.S. PATENT DOCUMENTS 3,337,195 A 8/1967 Farison
3,342,271 A * 9/1967 Anthony, Jr. ..... 169/15
(Continued)

FOREIGN PATENT DOCUMENTS

WO 9423798 10/1994

OTHER PUBLICATIONS

International Search Report and Written Opinion for International Application No. PCT/US2010/062451 dated Aug. 23, 2011.
Extended European Search Report for Application No. EP 10 86 1496 dated Oct. 7, 2016.

*Primary Examiner* — Ryan Reis
(74) *Attorney, Agent, or Firm* — Carlson, Gaskey & Olds

(57) ABSTRACT

An exemplary fire suppression system includes a sprinkler nozzle. At least one conduit is connected to the nozzle for delivering a fire suppression fluid to the nozzle. The conduit and the nozzle establish a discharge path. A pneumatically driven pump is connected with the conduit for pumping fluid into the conduit. A gas source provides pressurized gas to the pump for driving the pump. The gas source also provides gas to the discharge path for achieving a desired discharge of the fluid from the nozzle. A controller selectively controls at least one of (i) the gas provided to the pump, which controls the fluid pressure in the conduit, or (ii) the gas provided to the nozzle or the conduit, which controls the gas pressure delivered to the nozzle.

14 Claims, 1 Drawing Sheet

(51) Int. Cl.
*A62C 5/02* (2006.01)
*A62C 99/00* (2010.01)

(58) Field of Classification Search
USPC ..... 169/9, 13, 14, 15, 44, 46; 239/303, 311, 239/369
See application file for complete search history.

(56) References Cited

U.S. PATENT DOCUMENTS

| | | | | | |
|---|---|---|---|---|---|
| 4,345,654 | A | | 8/1982 | Carr | |
| 5,255,747 | A | | 10/1993 | Teske et al. | |
| 5,411,100 | A | | 5/1995 | Laskaris et al. | |
| 5,713,417 | A | * | 2/1998 | Sundholm | 169/46 |
| 5,738,174 | A | * | 4/1998 | Sundholm | 169/46 |
| 5,799,735 | A | | 9/1998 | Sundholm | |
| 5,957,210 | A | | 9/1999 | Cohrt et al. | |
| 6,009,953 | A | | 1/2000 | Laskaris et al. | |
| 6,009,954 | A | | 1/2000 | Phillips | |
| 6,155,351 | A | * | 12/2000 | Breedlove et al. | 169/14 |
| 6,173,791 | B1 | | 1/2001 | Yen | |
| 6,267,183 | B1 | * | 7/2001 | Smagac | 169/30 |
| 6,390,203 | B1 | | 5/2002 | Borisov et al. | |
| 6,991,041 | B2 | | 1/2006 | Laskaris et al. | |
| 7,712,542 | B2 | | 5/2010 | Munroe | |
| 2005/0173131 | A1 | * | 8/2005 | Dunster et al. | 169/44 |
| 2008/0185159 | A1 | | 8/2008 | Walsh | |
| 2010/0175897 | A1 | * | 7/2010 | Crump | 169/14 |
| 2010/0294518 | A1 | | 11/2010 | Lelic et al. | |

* cited by examiner

FIRE SUPPRESSION SYSTEM WITH VARIABLE DUAL USE OF GAS SOURCE

BACKGROUND

There are a variety of fire suppression systems. Many utilize sprinkler heads or nozzles mounted near a ceiling in various positions in a room. Some such systems are known as deluge systems. These release a relatively large amount of water responsive to a fire condition to douse a fire and saturate objects in the room to prevent them from igniting.

Other sprinkler-based fire suppression systems release a fine mist into a room responsive to a fire condition. One advantage to such systems over deluge systems is that they use less water. On the other hand, some misting systems require relatively high pressure to achieve the desired discharge of fire suppressing fluid. Typical misting systems use pressurized gas to shear the fluid as it is dispersed from the nozzles.

Many misting sprinkler fire suppression systems include a pump to achieve the pressures necessary for system operation. Water-based misting systems, for example, require an operating pressure that is higher than the typical pressure available from a municipal water supply. The pump is often one of the most expensive components of the system, which hinders an ability to reduce the cost of the system. Some systems also include pressurized gas tanks that pressurize the fluid lines that deliver the fluid to the sprinkler nozzles.

SUMMARY

An exemplary fire suppression system includes a sprinkler nozzle. At least one conduit is connected to the nozzle for delivering a fire suppression fluid to the nozzle. The conduit and the nozzle establish a discharge path. A pneumatically driven pump is connected with the conduit for pumping fluid into the conduit. A gas source provides pressurized gas to the pump for driving the pump. The gas source also provides gas to the discharge path for achieving a desired discharge of the fluid from the nozzle. A controller selectively controls at least one of (i) the gas provided to the pump, which controls the fluid pressure in the conduit, or (ii) the gas provided to the nozzle or the conduit, which controls the gas pressure delivered to the nozzle.

An exemplary method of operating a fire suppression system includes driving a pneumatically driven pump with pressurized gas from a gas source to cause the pump to deliver a pressurized fluid through a conduit to a nozzle. A desired discharge of the fluid from the nozzle is achieved by providing gas from the gas source to the discharge path established by the conduit and the nozzle. Selectively varying at least one of (i) the gas provided to the pump or (ii) the gas provided to the nozzle controls the discharge from the nozzle.

The various features and advantages of disclosed examples will become apparent to those skilled in the art from the following detailed description. The drawings that accompany the detailed description can be briefly described as follows.

DETAILED DESCRIPTION

Figure 1:
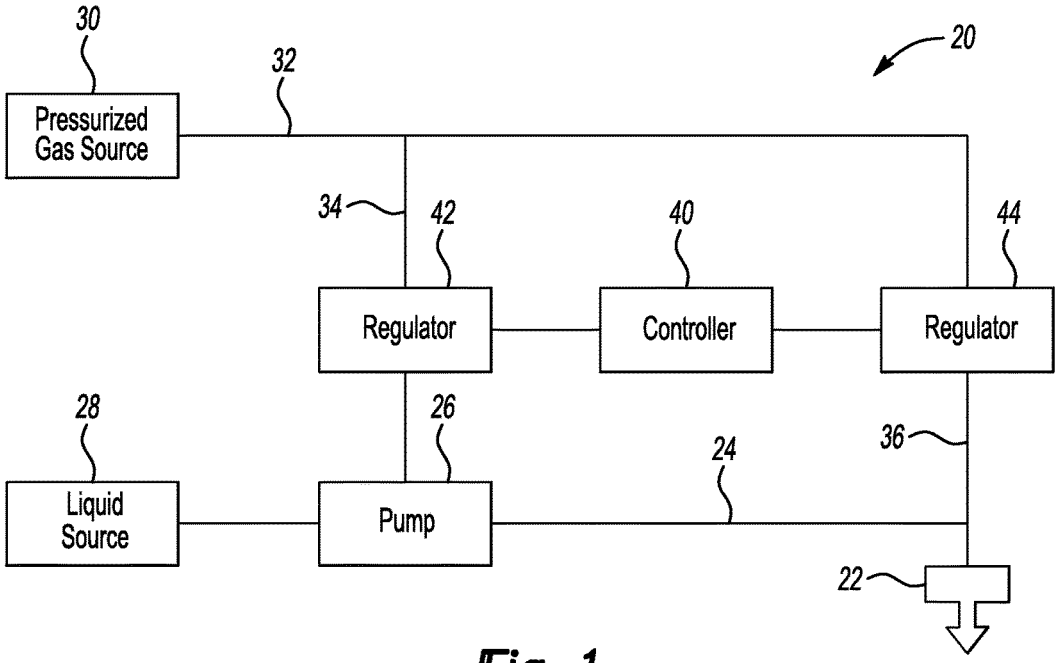
FIG. 1 schematically illustrates selected portions of a fire suppression system designed according to an embodiment of this invention.

FIG. 1 schematically shows selected portions of a fire suppression system 20. An example sprinkler nozzle 22 is positioned to discharge a fire suppressing fluid into an area responsive to a fire condition. The nozzle 22 is connected to a conduit 24. The nozzle 22 and the conduit 24 establish a discharge path. A pump 26 causes fluid from a source 28 to flow through the conduit to the nozzle 22. In one example the fluid comprises water and the source 28 is a municipal water supply. In another example, the fluid source 28 is a reservoir of a selected fluid such as water. In one example the fluid reservoir is at ambient pressure.

The pump 26 in this example is a pneumatically driven hydraulic pump. The pump 26 delivers the fluid (e.g., water) to the nozzle 22 through the conduit 24 when the pump 26 is driven by pressurized gas. The illustrated example includes a pressurized gas source 30 that provides pressurized gas through a supply line 32. In one example the gas source 30 comprises a rotary compressor. In another example, the gas source 30 comprises at least one pressurized tank. The gas may be air or carbon dioxide or nitrogen for example.

One branch 34 of the supply line 32 delivers pressurized gas to the pump 26 to drive the pump 26 for delivering the fluid from the supply 28 to the nozzle 22. Another branch 36 of the supply line 32 delivers the gas to the discharge path (i.e., at least one of the nozzle 22 or the conduit 24) at some point (e.g., upstream of the nozzle 22 or at the nozzle 22) to achieve a desired discharge of the fire suppressing fluid from the nozzle 22. The particular location at which the gas is introduced for achieving the desired discharge will depend on the particular design of the system 20, the nozzle 22 or both. For example, a system that relies upon mixing gas and liquid upstream of the nozzle 22 will include a branch 36 that provides the pressurized gas into the conduit 24 at a suitable location. Another system that relies upon mixing gas and liquid within the nozzle 22 will include the branch 36 coupled to a suitable inlet of the nozzle 22.

Given this description and a chosen system or nozzle configuration, those skilled in the art will be able to determine the best location for introducing the gas for achieving the desired discharge.

One feature of the illustrated example is that the same gas source 30 provides pressurized gas for driving the pump 26 and pressurized gas to achieve the desired discharge from the nozzle 22.

This example eliminates a separate electrical connection for the pump 26. For systems 20 that include pressurized cylinders as the gas source 30, no electrical connection is required for the entire system. Another feature of the illustrated example is that it reduces the footprint (or occupied space) of the pump compared to other systems that do not include such a pump. It also utilizes the gas source 30 for the dual purpose of supplying gas to the system 20 to achieve a desired discharge from the nozzle 22 and to drive the pump 26. This provides a lower cost arrangement for a supply of liquid and gas (e.g., water and air) that provides the desired pressure of each for the system 20.

The illustrated example system 20 includes a controller 40 that controls the operation of regulators 42 and 44, respectively. The controller 40 selectively varies the pressure or amount of gas that flows to the pump 26 by controlling the regulator 42. The controller 40 selectively varies the pressure or amount of gas that flows to the nozzle 22 or conduit 24 by controlling the regulator 44. By controlling at least one of the gases provided to the pump 26 or the gas provided to the nozzle 22, the discharge from the nozzle can be selectively controlled.

In one example, the controller 40 is programmed to selectively vary the gas provided to at least one of the pump 26 or the nozzle 22 over time to achieve different discharges from the nozzle 22. In one such example, the discharge from the nozzle 22 depends, at least in part, on the ratio of the gas to the liquid provided to the nozzle 22. Controlling the gas provided to the pump 26 or the nozzle 22 controls the gas-to-liquid mass flow ratio and, thereby controls the discharge from the nozzle.

For example, less gas provided to the pump 26 can decrease the rate that the pump 26 delivers liquid to the conduit 24. To increase the gas-to-liquid ratio in one example, the controller 40 causes the regulator 42 to decrease the amount of gas or the pressure of the gas provided to the pump 26. In another example, the controller 40 causes the regulator 44 to increase the amount of gas or the pressure of the gas provided to the nozzle 22 (or the conduit 24). Another example includes controlling both regulators 42 and 44 to increase the gas-to-liquid ratio by increasing the gas provided through the regulator 44 and decreasing the gas provided through the regulator 42.

The controller 40 can also decrease the gas-to-liquid ratio by increasing the amount of gas that flows through the regulator 42 or the pressure of the gas through the regulator 42 for driving the pump 26. Increasing the output of the pump 26 by increasing the pressure or amount of gas used to drive the pump without changing the gas flow provided to the conduit 24 or nozzle 22 will decrease the gas-to-liquid ratio used for achieving a desired discharge from the nozzle 22. In another example, the controller 40 decreases the amount of gas provided to the conduit 24 or the nozzle 22. One example includes decreasing the gas provided to the nozzle 22 while increasing the gas provided to drive the pump 26 to achieve a desired, decreased gas-to-liquid ratio.

Whether the amount or pressure through either regulator changes may depend on the configuration of the regulator. For example, the regulator may comprise an expansion valve. By increasing the opening size of the expansion valve, a different resulting pressure of gas provided for driving the pump 26 will be realized. Another example regulator comprises a valve having a variable flow-through opening. By increasing the opening of the valve, an increased amount of gas provided to the pump 26 may be realized. Given this description, those skilled in the art will be able to select appropriate pump and regulator components and to control the gas provided to the particular pump they select in a manner that meets the needs of their particular situation.

Selectively varying the gas provided to the pump 26 or the nozzle 22 allows for selectively varying the gas-to-liquid ratio and, consequently, to vary the discharge from the nozzle 22. Varying the air-to-liquid ratio achieves different performance characteristics of the system 20. For example, different droplet size of a misting nozzle 22 may be achieved depending on the gas-to-liquid ratio. The velocity of discharge from the nozzle 22 also can be selectively controlled. The discharge pressure or discharge distance may also vary depending on the air-to-liquid ratio.

The illustrated example includes the controller 40 selectively varying the amount of gas used for driving the pump 26 or provided to the nozzle 22 for achieving at least two different performance characteristics each associated with the discharge from the nozzle 22. Taking droplet size as an example performance characteristic, the controller 40 controls the gas provided for driving the pump 26 or provided to the nozzle 22 to achieve two different droplet sizes discharged from the nozzle 22. Each performance characteristic or droplet size provides a different effect for fire suppression.

By selectively varying the gas-to-liquid ratio to achieve different discharge effects from the nozzle 22, the illustrated example allows for addressing different types of fire situations from a single system, for example. Some fire conditions may require a higher concentration of fire suppressing fluid directly beneath a nozzle while others may require a more widely dispersed discharge of the fire suppressing fluid. Utilizing different discharge pressures, velocities, droplet sizes or a combination of these during a single activation of the system 20 allows for addressing these different types of fire conditions using the single system. This feature enhances the overall capabilities of the system 20 compared to a system that only provides one type of nozzle discharge during system activation. The controller 40 in the illustrated example selectively varies the gas provided to the pump 26 or the gas provided to the nozzle 22 to achieve more than one performance characteristic during a single activation of the system 20. Not only does the varying performance characteristic allow for addressing different types of fire situations but it may enhance the ability to more quickly address a particular type of fire condition.

In one example, the controller 40 continuously varies the gas-to-liquid ratio by varying at least one of the gas provided for driving the pump 26 or the gas provided to the nozzle 22 between selected maximum and minimum values. In one example a sinusoidal pattern for varying the gas allows for a smooth, continuous transition over time. This allows for a relatively continuous variation in the discharge from the nozzle 22 and a cycling back-and-forth between selected extremes (e.g., maximum and minimum droplet size).

Another example includes the controller 40 varying the gas provided to the pump 26 or to the nozzle 22 intermittently between selected values. In one such example, the controller 40 effectively follows a square wave pattern between a high and low value of the varied amount of gas. This allows for pulsing the discharge from the system, for example.

In one example, the variation has a frequency between 0.01 Hz and 1.0 Hz such that the discharge from the nozzle 22 varies between two selected extremes at an interval in a range between every second and every ten seconds.

One example includes the controller 40 monitoring an amount of fluid provided to the pump 26 from the source 28. In some cases, the amount of fluid available may vary over time. To achieve a consistent or desired discharge from the nozzle 22, the controller 40 adjusts the gas provided for driving the pump 26, to the nozzle 22 or both to ensure that the desired discharge from the nozzle 22 is achieved even when there may be a variation in the amount of fluid available for the pump 26 to provide to the nozzle 22. In one such example, the discharge from the nozzle 22 does not change over time even though the gas-to-liquid ratio is changed by the controller 40.

Figure 2:
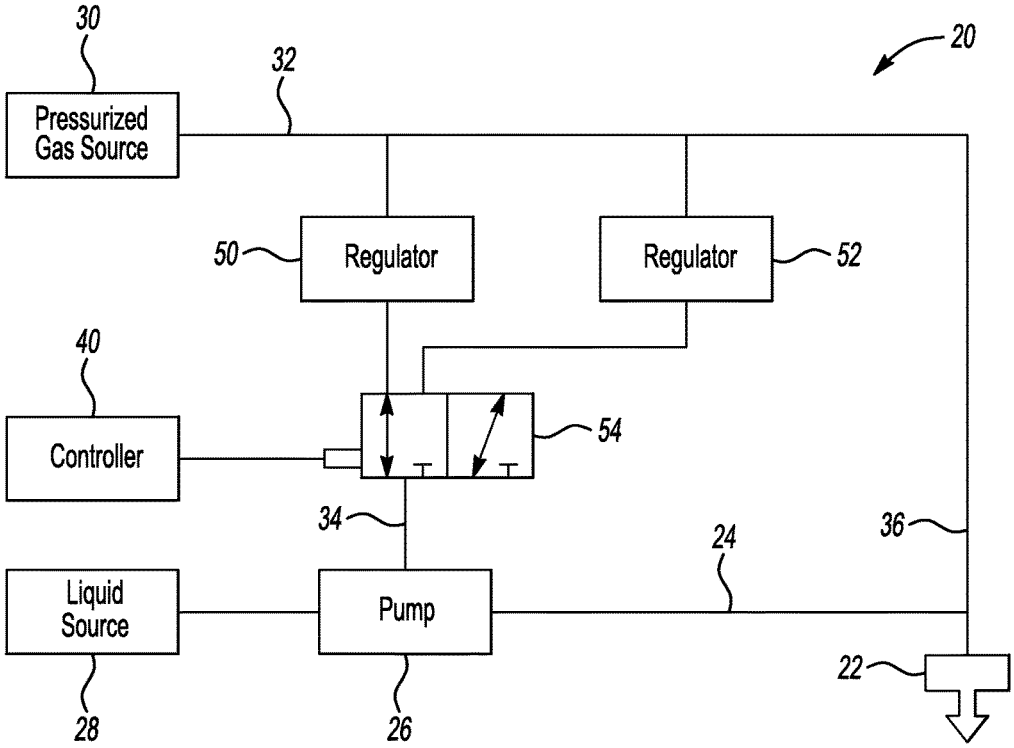
FIG. 2 schematically illustrates another example embodiment.

FIG. 2 illustrates another example embodiment of a fire suppression system 20. In this example, the amount of gas provided along the branch 36 to the conduit 24 or the nozzle 22 does not vary. This example includes a high level regulator 50 and a low level regulator 52 between the gas supply line 32 and the pump 26. A valve 54 controlled by the controller 40 switches between the regulators 50 and 52 depending on whether more or less gas for driving the pump 26 is desired. The illustrated example includes a solenoid valve 54 for this purpose. This example allows for varying the water pressure or the amount of water supplied by the pump 26 to the nozzle 22 (when water is the selected fire suppressing fluid). Varying the amount of gas for driving the pump 26 allows for achieving different gas-to-liquid ratios at the nozzle 22 and, consequently, achieving different discharge from the nozzle 22.

One feature of the illustrated examples is that relatively simple component design can be incorporated into the system 20, which minimizes complexity and cost. For example, the nozzle 22 need not have any switching components for purposes of varying the flow from or discharge from the nozzle 22. Instead, the controller 40 selectively controls the gas-to-liquid ratio for purposes of selectively varying the discharge from the nozzle 22. Eliminating moving parts within the nozzle 22 simplifies the design and provides a more reliable system, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A sprinkler system, comprising:

a sprinkler nozzle;

at least one conduit connected with the nozzle for delivering at least a fire extinguishing fluid to the nozzle, the nozzle and the conduit establishing a discharge path;

a pneumatically driven pump connected with the conduit for pumping fluid into the conduit;

a gas source providing pressurized gas to the pump for driving the pump, the gas source providing the gas to the discharge path to achieve a desired discharge of extinguishing fluid from the nozzle; and a controller that selectively controls (i) the gas provided to the pump to thereby control a pressure of the fluid in the conduit and (ii) the gas provided to the nozzle or the conduit to thereby control an amount of the gas delivered to the nozzle, wherein the controller varies at least one of (i) and (ii) between selected values in at least one of a cyclical, continuous or intermittent manner.

2. The sprinkler system of claim 1, wherein the controller varies at least one of (i) and (ii) to achieve at least two different performance characteristics of the system.

3. The sprinkler system of claim 2, wherein the system performance characteristics are realized during a single activation of the system.

4. The sprinkler system of claim 2, wherein the different performance characteristics comprise at least two different discharge pressures, at least two different discharge distances, at least two different droplet sizes, or at least two different discharge velocities.

5. The sprinkler system of claim 1, wherein the controller determines at least one of a volume or a pressure of the fluid provided to the pump and responsively adjusts at least one of (i) or (ii) to achieve a desired discharge of the fluid from the nozzle.

6. The sprinkler system of claim 1, wherein the gas source delivers the gas to the conduit.

7. The sprinkler system of claim 1, wherein the gas source delivers the gas to the nozzle.

8. A method of suppressing fire, comprising the steps of:

providing pressurized gas to a pneumatically driven pump that is connected with a conduit having a nozzle near an end of the conduit, the gas driving the pump for pumping fluid into the conduit, the conduit and the nozzle establishing a discharge path;

providing the gas to the discharge path for achieving a desired discharge of extinguishing fluid from the nozzle; and selectively controlling (i) the gas provided to the pump to thereby control a pressure of the fluid in the conduit and (ii) the gas provided to the nozzle or the conduit to thereby control an amount of the gas delivered to the nozzle by varying at least one of (i) and (ii) between selected values in at least one of a cyclical, intermittent or continuous manner.

9. The method of claim 8, comprising delivering the gas to the conduit.

10. The method of claim 8, comprising delivering the gas to the nozzle.

11. The method of claim 8, comprising varying at least one of (i) and (ii) to achieve at least two different performance characteristics of the system.

12. The method of claim 11, comprising achieving the different system performance characteristics during a single activation of the system.

13. The method of claim 11, comprising achieving at least two different discharge pressures, at least two different discharge distances, at least two different droplet sizes, or at least two different discharge velocities.

14. A sprinkler system, comprising:

a sprinkler nozzle;

at least one conduit connected with the nozzle for delivering at least a fire extinguishing fluid to the nozzle, the nozzle and the conduit establishing a discharge path;

a pneumatically driven pump connected with the conduit for pumping fluid into the conduit;

a gas source providing pressurized gas to the pump for driving the pump, the gas source providing the gas to the discharge path to achieve a desired discharge of extinguishing fluid from the nozzle; and a controller that selectively controls (i) the gas provided to the pump to thereby control a pressure of the fluid in the conduit and (ii) the gas provided to the nozzle or the conduit to thereby control an amount of the gas delivered to the nozzle wherein the controller determines at least one of a volume or a pressure of the fluid provided to the pump and adjusts at least one of (i) or (ii) based on the determined volume or pressure to achieve a desired discharge of the fluid from the nozzle.

* * * * *